United States Patent [19]

Meisel

[11] 4,045,639

[45] Aug. 30, 1977

[54] CONTINUOUS MICROWAVE AND VACUUM DRYER

[75] Inventor: Nicolas Meisel, Epone, France

[73] Assignee: Food Processing Systems Corporation, Del.

[21] Appl. No.: 637,420

[22] Filed: Dec. 3, 1975

Related U.S. Application Data

[63] Continuation-in-part of Ser. No. 432,814, Jan. 14, 1974, abandoned.

[30] Foreign Application Priority Data

Jan. 16, 1973 Switzerland ..... 570/73

[51] Int. Cl.[2] ..... H05B 9/06

[52] U.S. Cl. ..... 219/10.55 A; 219/10.55 M

[58] Field of Search ..... 219/10.55 R, 10.55 A, 219/10.55 M

[56] References Cited

U.S. PATENT DOCUMENTS

| | | | |
|---|---|---|---|
| 3,365,562 | 1/1968 | Jeppson | 219/10.55 A |
| 3,440,383 | 4/1969 | Smith | 219/10.55 R |
| 3,495,648 | 2/1970 | Amadon | 219/10.55 R |
| 3,507,050 | 4/1970 | Smith et al. | 219/10.55 A |
| 3,545,093 | 12/1970 | Forster | 219/10.55 A |
| 3,549,848 | 12/1970 | Williams | 219/10.55 A |
| 3,590,202 | 6/1971 | Day et al. | 219/10.55 R |
| 3,670,132 | 6/1972 | Kaufman, Jr. et al. | 219/10.55 A |
| 3,718,082 | 4/1971 | Lipoma | 219/10.55 A |
| 3,721,013 | 3/1973 | Miller | 219/10.55 M |
| 3,725,628 | 10/1971 | Johnson | 219/10.55 A |
| 3,731,036 | 5/1973 | Hallier et al. | 219/10.55 A |
| 3,746,822 | 7/1973 | Le Viet | 219/10.55 A |
| 3,780,251 | 12/1973 | Kee | 219/10.55 A |
| 3,834,038 | 9/1974 | Janda | 219/10.55 R |

*Primary Examiner*—Arthur T. Grimley
*Attorney, Agent, or Firm*—Stevens, Davis, Miller & Mosher

[57] ABSTRACT

This invention relates to an apparatus, namely a continuous microwave and vacuum dryer, useful for evaporating a liquid from a liquid containing material by means of microwave and vacuum.

This apparatus, especially suitable for continuous dehydration of foodstuffs, comprises a housing forming a closed elongated space, means for evacuating said closed space, means for partitioning the closed space into two chambers which communicate through a slit provided in the partition, a conveyor belt disposed longitudinally in the two chambers, means for feeding on the conveyor belt a material to be evaporated, at least one source of microwave energy fed into the first one of the two chambers by at least one adjustable microwave cavity at atmospheric pressure through an air tight membrane provided on the first chamber.

8 Claims, 1 Drawing Figure

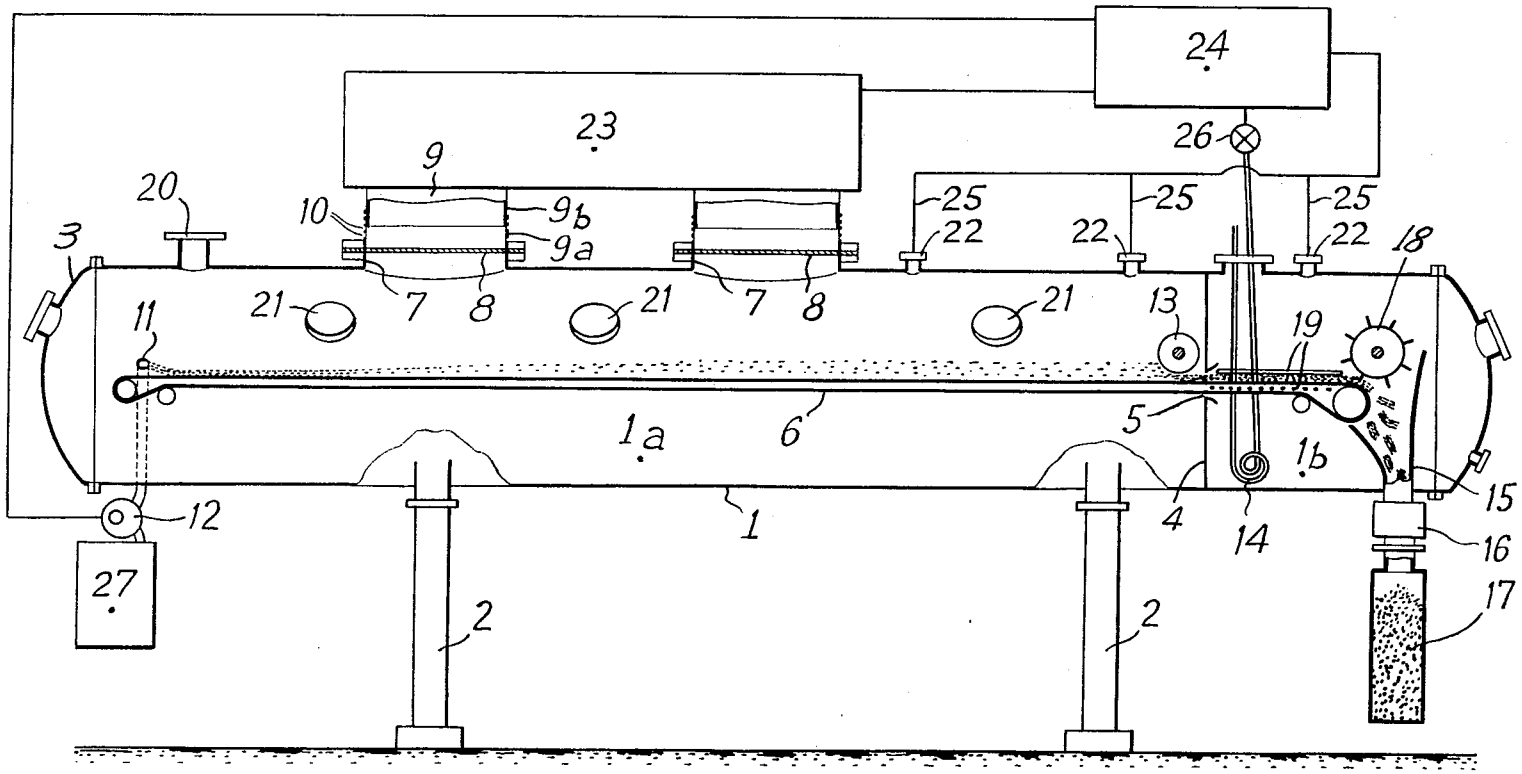
1
1a
1b
2
2
3
4
5
6
7
7
8
8
9
9a
9b
10
11
12
13
14
15
16
17
18
19
20
21
21
21
22
22
22
23
24
25
25
25
26
27

CONTINUOUS MICROWAVE AND VACUUM DRYER

CROSS-REFERENCE TO RELATED APPLICATION

This application is a continuation-in-part of my previous U.S. patent application, Ser. No. 432814 of Jan. 14, 1974, now abandoned.

BACKGROUND OF THE INVENTION

1. Field of the Invention

This invention is related to the food and pharmaceutical industry and is particularly concerned with an apparatus for continuous microwave and vacuum drying, in which (i) glow discharge is prevented and (ii) the material to be treated is submitted to foaming at a low temperature (for instance at a temperature lower than or equal to 40° C, if required), and which is useful for obtaining a dried end-product having excellent rehydration capabilities.

2. Description of the Prior Art

The principle of using microwaves and vacuum for drying is known. U.S. Pat. No. 3,276,138 describes a certain number of possibilities, the object of all of which is to prevent ionisation, but the device of this patent, like those described in U.S. Pat. Nos. 2,859,534 and 3,048,928, relate to apparatuses which function intermittently.

In these apparatuses, the electric field increases as the amount of energy abosrbed by the quantity of product present decreases, this decrease being due to evaporation and removal of the liquid as heating progresses.

The critical value of the field is thus reached quickly, and to prevent the ionisation which would result therefrom the microwave power must be reduced, which leads to a decrease in the rate of drying and to use of the apparatus below its maximum yield.

Moreover U.S. Pat. No. 3,365,562 discloses a microwave oven for cooking foodstuffs, which comprises a heating compartment which is not hermetically closed, and reflectors which are provided on the top side of the compartment where microwaves are injected. U.S. Pat. No. 3,507,050 proposes a meander waveguide for drying sheet materials at atmospheric pressure and use of rollers outside the microwave field to convey the sheets. U.S. Pat. No. 3,545,093 discloses a means for microwave removal of volatile polar vehicles from non-polar materials, and especially a resonating cavity with air inlets and outlets and a vibrating plate as a material handling means, but it does not teach how to affect microwave evaporation under vacuum in a continuous apparatus. U.S. Pat. No. 3,780,251 describes a tunable waveguide the dimensions of which do not change. U.S. Pat. No. 3,834,038 discloses an apparatus for drying plastic resings with microwave energy in a partial vacuum, which does not comprise a primary non-evacuated microwave cavity through which microwaves are fed into an evacuated chamber as it is the case in this application.

SUMMARY OF THE INVENTION

In accordance with the invention, the microwave-vacuum drying apparatus comprises a. a housing forming a closed elongated space, b. means for evacuating said closed space;

c. means impermeable to microwave energy for partitioning the closed space into first and second chambers, said partition having a slit therein;

d. an endless conveyor belt disposed longitudinally in the closed space and through the slit;

e. means for feeding on the belt a product containing a liquid to be evaporated;

f. at least one source of microwave energy fed into the first evacuated chamber through at least one adjustable microwave cavity at atmospheric pressure, microwave permeable but air tight membranes sealing the non-evacuatate microwave cavity from said evacuated first chamber;

g. means disposed in the second chamber for absorbing microwave which have passed through said slit; and h. means for discharging the product from the apparatus.

The adjustable microwave cavity at atmospheric pressure is also called hereinafter the primary cavity. The apparatus according to this invention preferably comprises two of these primary cavities.

DESCRIPTION OF THE INVENTION

According to the present invention there is provided a microwave-vacuum dryer for the continuous evaporation of a liquid containing material and preferably for the dehydration of water containing material. Such a dryer comprises a housing forming an elongated closed space which is divided into two chambers: the first chamber receives microwave energy, the second chamber is adapted to be subjected to a low microwave energy field. The first and second chambers are partitioned by a partition which is impermeable to microwave energy and which possesses a slit.

An endless conveyor belt for conveying the material to be treated i.e. dehydrated, from the first chamber to the second chamber through the slit is disposed longitudinally in the closed space.

In the first chamber of the closed space there is at least one window through which the microwave energy is fed into the closed space, a wall of non-absorbent material sealing said window from an adjustable microwave cavity at atmospheric pressure.

Preferably each adjustable microwave cavity, which is provided, is cylindrical and is much larger than a waveguide. The height of said cavity is variable due to the fact that it is formed by two concentric and closely adjusted cylinders sliding one within the other. The reason for using such a primary microwave cavity of greater dimensions than a waveguid is to obtain accross the microwave transparent window between the adjustable primary cavity at atmospheric presure and the first evacuated chamber; a regular and reduced microwave field value, thus allowing maximum microwave energy input into the evacuated chamber compatible with the existing vacuum, with practically no glow discharge risks.

Advantageously the adjustable microwave cavity is provided with ventilating means in order to reduce the temperature of the microwave permeable membrane which is disposed between the first chamber and said adjustable primary cavity.

The closed space is also provided with means for evacuation in order to obtain, for instance a vacuum of 1-20 Torrs. In the first evacuated chamber are provided means for feeding on the conveyor belt a product containing a liquid to be evaporated; these means include devices such as air lock devices, for instance pump supplied rows of jets, in order to drop or to inject the product to be treated onto the feed end of the continuous conveyor belt.

The second chamber is provided with means for absorbing microwaves which have passed through the slit. For that purpose a pipeline or a coil, with a steam of water inside it, may be disposed in the second chamber. The second chamber contains also means for continuous removal of the treated product from the apparatus, and means for cooling.

The closed space is also provided with detector devices for controlling the temperature of the product and the moisture during preocessing. Infra-red detectors are employed to measure the surface temperature of the product and/or the moisture content.

An illustrative embodiment of the present invention will now be described with reference to the accompanying drawing in which illustrates a diagrammatic view in longitudinal cross-section of one form of microwave vacuum dryer.

Referring now to the drawing there is shown a vacuum microwave dryer comprising a cylindrical housing supported by feet 2 closed at each end by a sealed door 3 and which forms an elongated closed space. This cylindrical closed space is divided into two chambers 1*a* and 1*b* by a metal partition 4 containing a slit 5 to enable a flexible belt 6, for instance made of non-absorbent material such as polyethylene, to pass therethrough.

Chamber 1*a* receives the microwave radiation through two windows 7 sealed by a microwave permeable but air tight membrane 8 made of a rather non-absorbent material. The membrane 8 separates the closed space from adjustable cavities 9, consisting of metal cylinders 9*a* and 9*b* pierced with holes 10 which make it possible to ventilate each cavity for the purpose of cooling the membrane 8 which, because of the vacuum existing on one of its faces and the sprayed material which it can receive, has a tendency, during continuous operation, to heat up even if the material used has very low dielectric losses at the frequency used.

In chamber 1*a*, a row of jets 11 for injecting the liquid product to be dehydrated is provided above the belt 6, this row of jets being supplied by a pump 12 connected to a product container 27.

As it is being dehydrated, the product foams, and in order to enable it to pass through the slit 5, a compressing roller 13 is provided and is located in front of the slit, this roller being made of a material which does not absorb microwaves.

Since chamber 1*b* is separated by a metal partition 4, the microwave field therein is very low, and in order to absorb the energy of this field, a pipeline or coil 14, made of material with a low dielectric coefficient, is provided inside it. A stream of water, the flow rate of which can be adjusted by means of water valve 26, is passed through this pipeline or coil 14, the volume of water admitted being proportional to the excess microwave energy to be absorbed.

At the end of the belt, chamber 1*b* contains a vibrating funnel 15 connected via a valve 16 to a collecting reservoir 17 which received the dehydrated product which is broken up into small pieces by a bladed drum 18.

Moreover, on either side of the upper portion of the belt, cooling plates 19 are provided in order to cool the product in chamber 1*b*.

The closed space also contains a coupling 20 for evacuating it and observation ports 21. In order to control the dehydration operation, it is necessary to check the temperature and/or the moisture content. Since it is not possible to introduce a detector inside the closed space, infra-red temperature and moisture detectors 25 are mounted on small ports 22 are employed to measure (i) the surface temperature of the product, that is to say practically the temperature inside the product since the vacuum insulates the latter thermally, and (ii) if necessary, the moisture content.

By checking one of these two parameters, temperature and moisture content, or both simultaneously, it is possible to adjust the forward movement of the belt or in the case of overheating, to adjust the emission of the magnetron and/or the speed of the belt and/or the output of the injecting pump. For that purpose infra-red detectors 25, the pump 12, the water valve 26 and the microwave generators are connected to a control device 24 which regulates the whole operation.

The magnetrons or microwave generators are mounted in a case 23 surmounting the tubes 9*a* and 9*b*, it being possible to adjust the vertical position of the combination in order to make the cavities 9 correspond to the product present in the microwave vacuum dryer.

Furthermore, since the belt is flexible, guide-strips can be provided under its edges in order to raise the edges and to give the upper portion of the belt the shape of a gutter.

The dryer according to the invention (which possesses an elongated closed space for avoiding as much as possible important variations of the electrical field) is suitable for preparing instant water soluble or water dispersible product from food or from pharmaceutical or dietetical products such as organ extracts and plant extracts.

Here is for instance how the microwave vacuum dryer works. Food concentrate (in the form of a heavy slurry having a solid content as high as 60% by weight), is injected by the row of jets 11, or even a whole food item such as asparagus stems or mushrooms is dropped through a suitable air lock device, onto the feed end of a continuous conveyor belt the speed of which is adjustable (for instance from 1 to 30 m per hour). Under the action of the microwave field and the vacuum (which is adjustable at 1–20 Torrs) the water particles contained in the material to be treated, vibrate at high frequencies and foam out of the material, in the first evacuated chamber, at a temperature which is lower than or equal to 30° C.

The foam reaches the second evacuated chamber where it is subjected to a low microwave energy field, and where the temperature may be higher than 30° C but is always set below 40° C.

The foam which has become a meringue is broken up inside the second evacuated chamber and removed as a dry powder (with an apparent density of less than 0.10) by means of the collecting reservoir 17.

The temperature infra-red detectors focusing on the treated material in chambers 1*a* and 1*b* have a control point set always below 40° C in order to regulate (i) magnetron power, (ii) belt and material admission speeds, and (iii) water stream flow in conduit 14 (by means of valve or pump 26). The complete process, for instance, from first slurry in to first powder out takes about 15–45 minutes.

Various modifications of the continuous microwave vacuum dryer are possible. For instance, the closed space could be parallelepiped-shaped or could contain several superposed belts. Likewise, an inlet and outlet pressure lock for the dehydration of solid products could be attached to the elongated closed space. The number of cavities 9 could also be increased by locating them on both sides of the conveyor belt or belts, which involves a corresponding increase in the number or power of the microwave generators.

What I claim is:

1. An apparatus for continuous microwave and vacuum drying a liquid containing material which comprises:

a. a housing forming a closed elongated space;

b. means for evacuating said closed space;

c. means impermeable to microwave energy for partitioning the closed space into first and second chambers, said partition having a slit therein;

d. an endless conveyor belt having a feeding end and a discharge end disposed longitudinally in the closed space and through the slit;

e. means for feeding on the belt a product containing a liquid to be evaporated;

f. at least one source of microwave energy fed into the first evacuated chamber through at least one adjustable microwave cavity at atmospheric pressure, microwave permeable but air tight membranes sealing the non-evacuated microwave cavity from said evacuated first chamber;

g. means disposed in the second chamber for absorbing microwaves which have passed through said slit; and h. means for discharging the product from the apparatus.

2. The apparatus of claim 1 wherein the means disposed in the second chamber for absorbing microwaves is a conduit containing water.

3. The apparatus of claim 2 wherein a roller which does not absorb microwaves is disposed above the belt adjacent to said partition in the first chamber where it will compress material on the belt.

4. The apparatus of claim 2 having means for cooling product on the belt in the second chamber.

5. The apparatus of claim 2 comprising means for removing product from the belt adjacent the discharge end thereof.

6. The apparatus of claim 2 comprising infra-red detectors for measuring the temperature or the moisture content of material on the belt, and means for controlling the movement of the conveyor belt and the rate at which product is fed to the belt and the energy of the microwaves in response to the measurements from the detectors.

7. The apparatus of claim 2 wherein ventilating means are provided for said adjustable non-evacuated microwave cavity.

8. The apparatus of claim 1 wherein said adjustable microwave cavity is adapted to move towards and away from said belt and has telescoping walls.

* * * * *